US006065311A

United States Patent [19]

Essig et al.

[11] Patent Number: 6,065,311

[45] Date of Patent: May 23, 2000

[54] METHOD OF PRODUCING A KNITTED ARTICLE ON A FLAT KNITTING MACHINE

[75] Inventors: Horst Essig, Huelben; Oliver Vogt, Reutingen, both of Germany

[73] Assignee: H. Stoll GmbH & Co., Reutlingen, Germany

[21] Appl. No.: 09/123,752

[22] Filed: Jul. 27, 1998

[30] Foreign Application Priority Data

Sep. 2, 1997 [DE] Germany ..... 197 38 214

[51] Int. Cl.[7] ..... D04B 7/04

[52] U.S. Cl. ..... 66/64; 66/173

[58] Field of Search ..... 66/64, 69, 60 R, 66/170, 171, 173, 175, 176

[56] References Cited

U.S. PATENT DOCUMENTS

| | | | |
|---|---|---|---|
| 1,072,640 | 9/1913 | Nydegger | 66/64 |
| 1,572,434 | 2/1926 | Kaiser | 66/69 |
| 3,602,914 | 9/1971 | Castello | 2/90 |
| 4,005,494 | 2/1977 | Burn | 2/239 |
| 4,038,699 | 8/1977 | Burn | 2/239 |
| 4,040,275 | 8/1977 | Castello | 66/64 |
| 5,321,959 | 6/1994 | Mitsumoto | 66/75.1 |
| 5,361,607 | 11/1994 | Mitsumoto et al. | 66/69 |

*Primary Examiner*—Danny Worrell
*Attorney, Agent, or Firm*—Michael J. Striker

[57] ABSTRACT

A method of producing a knitting on a flat knitting machine with two opposite needle beds and a loop transferring device includes forming a knitting which has a base knitting and at least one parallel knitting partially overlapping the base knitting and formed of at least two flat knittings arranged in parallel planes, binding at least in a region of at least one parallel knitting at most each second needle of a needle bed with a loop of the base knitting and emptying a needle of the other needle bed which is opposite to the bound needle of the one needle bed, producing one of the flat knittings of the parallel knittings on the needle bed which is opposite to the needle bed for forming the base knitting, and producing the other flat knitting in the empty needles of the needle bed on which the base knitting is formed.

5 Claims, 12 Drawing Sheets

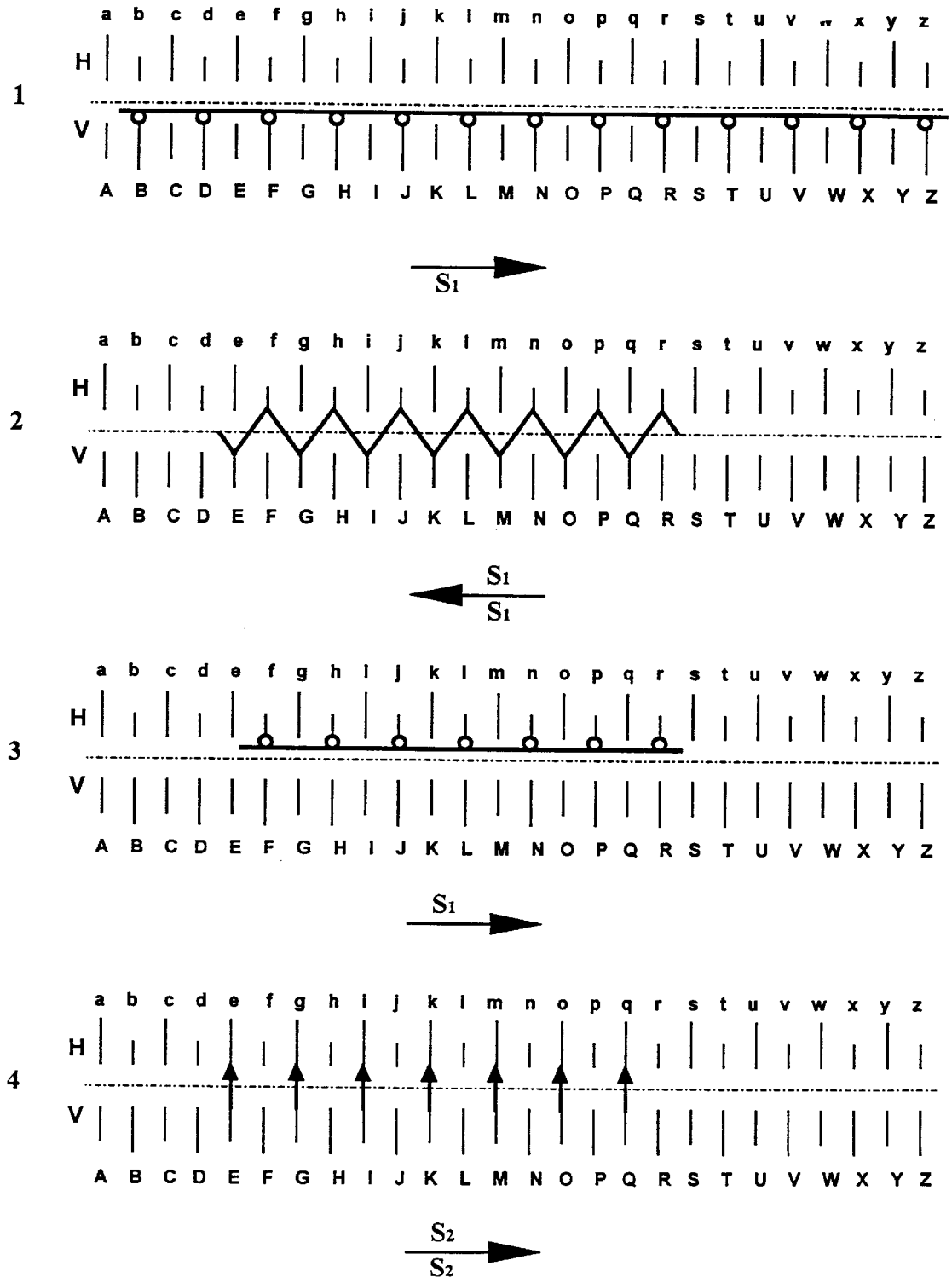
Fig. 2.1

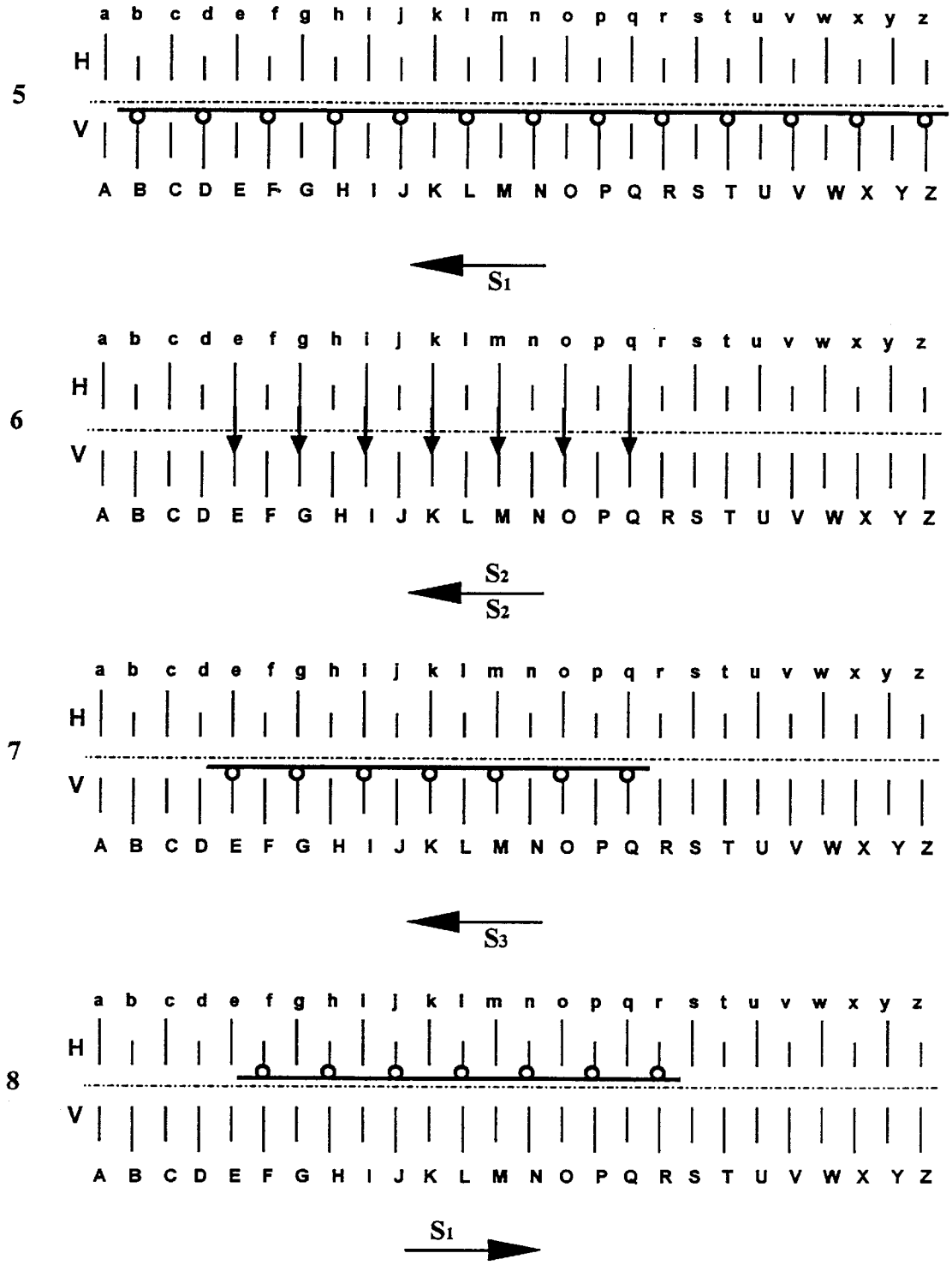
Fig. 2.2

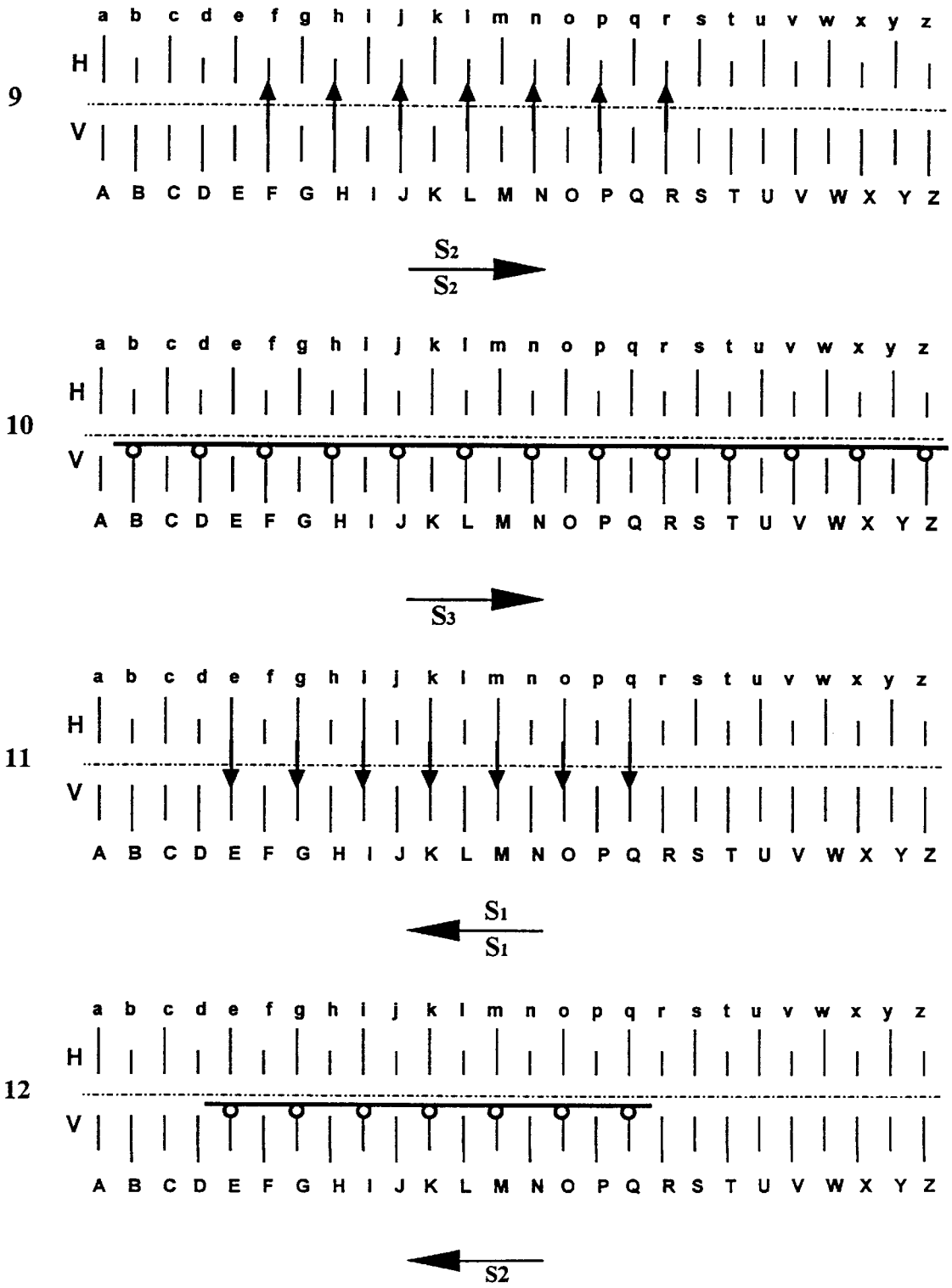
Fig. 2.3

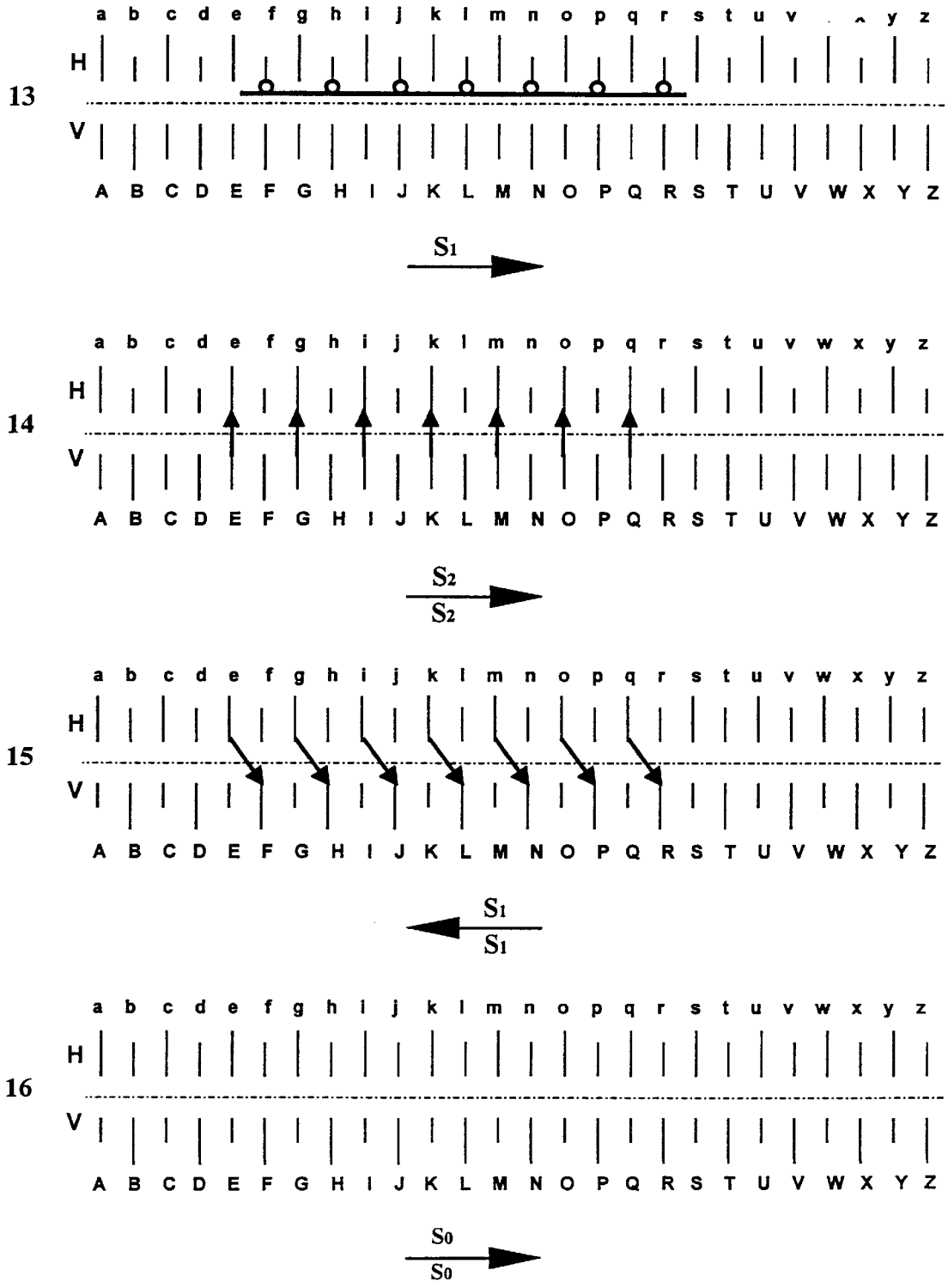
Fig. 2.4

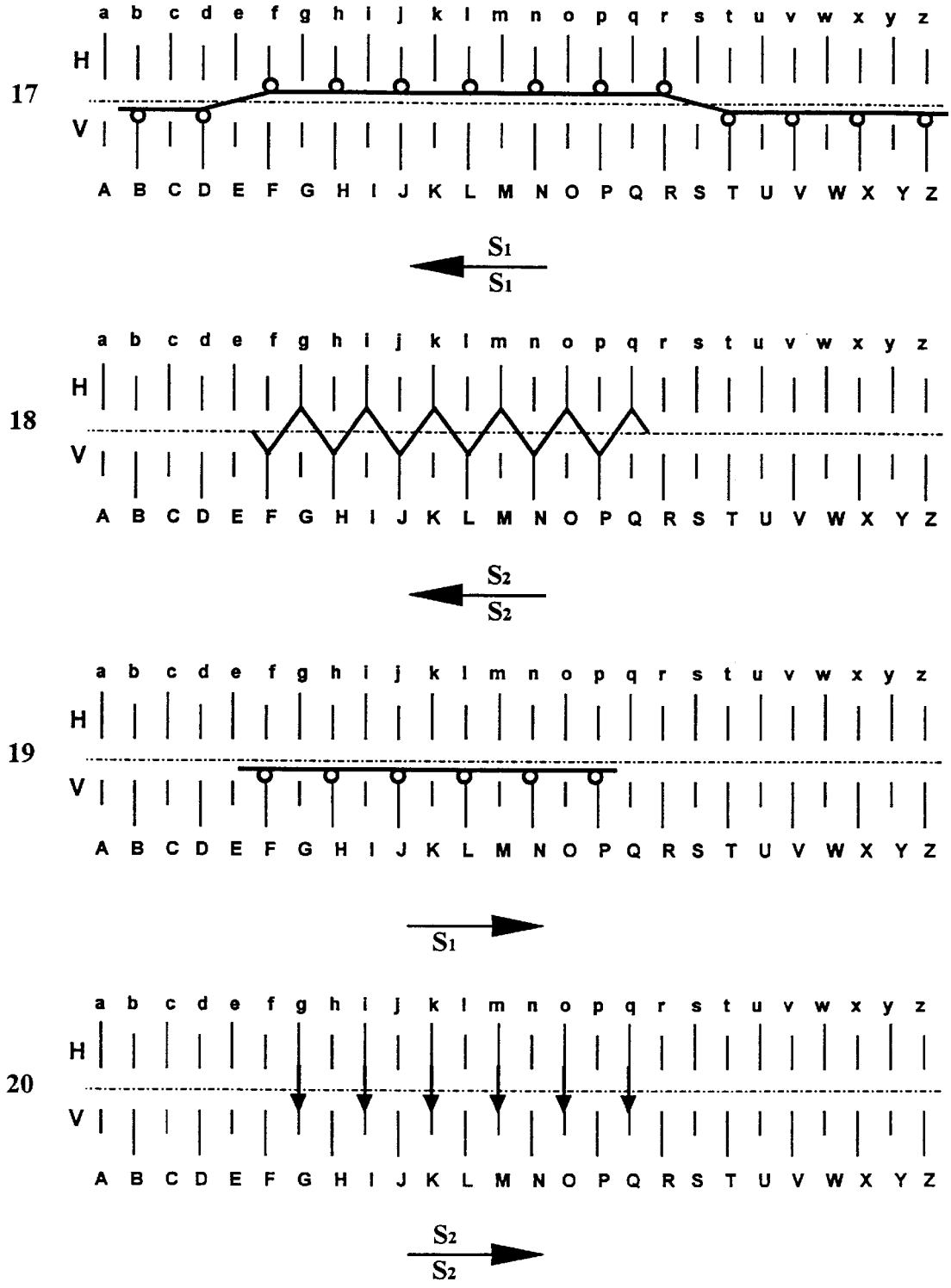
Fig. 2.5

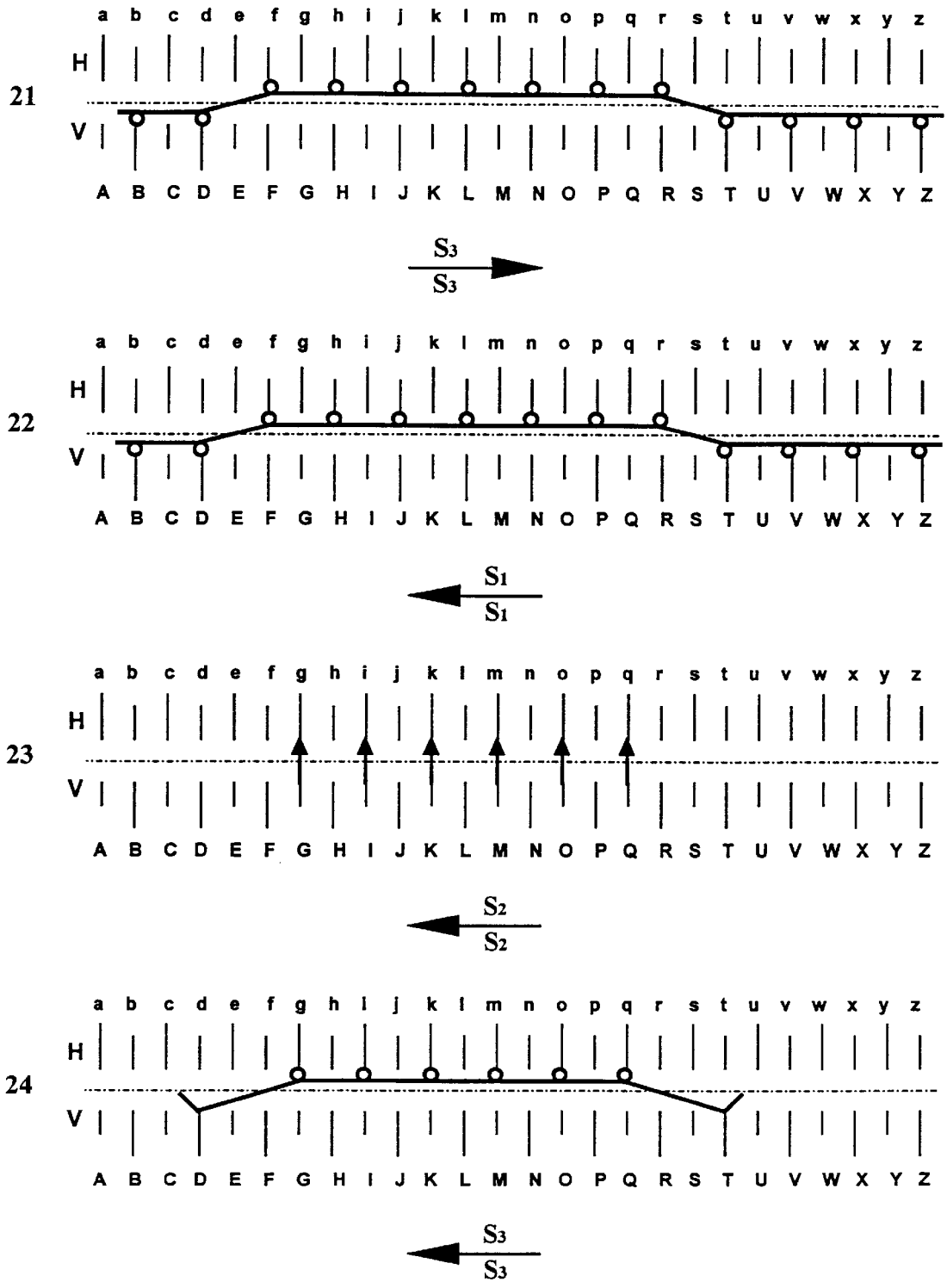
Fig. 2.6

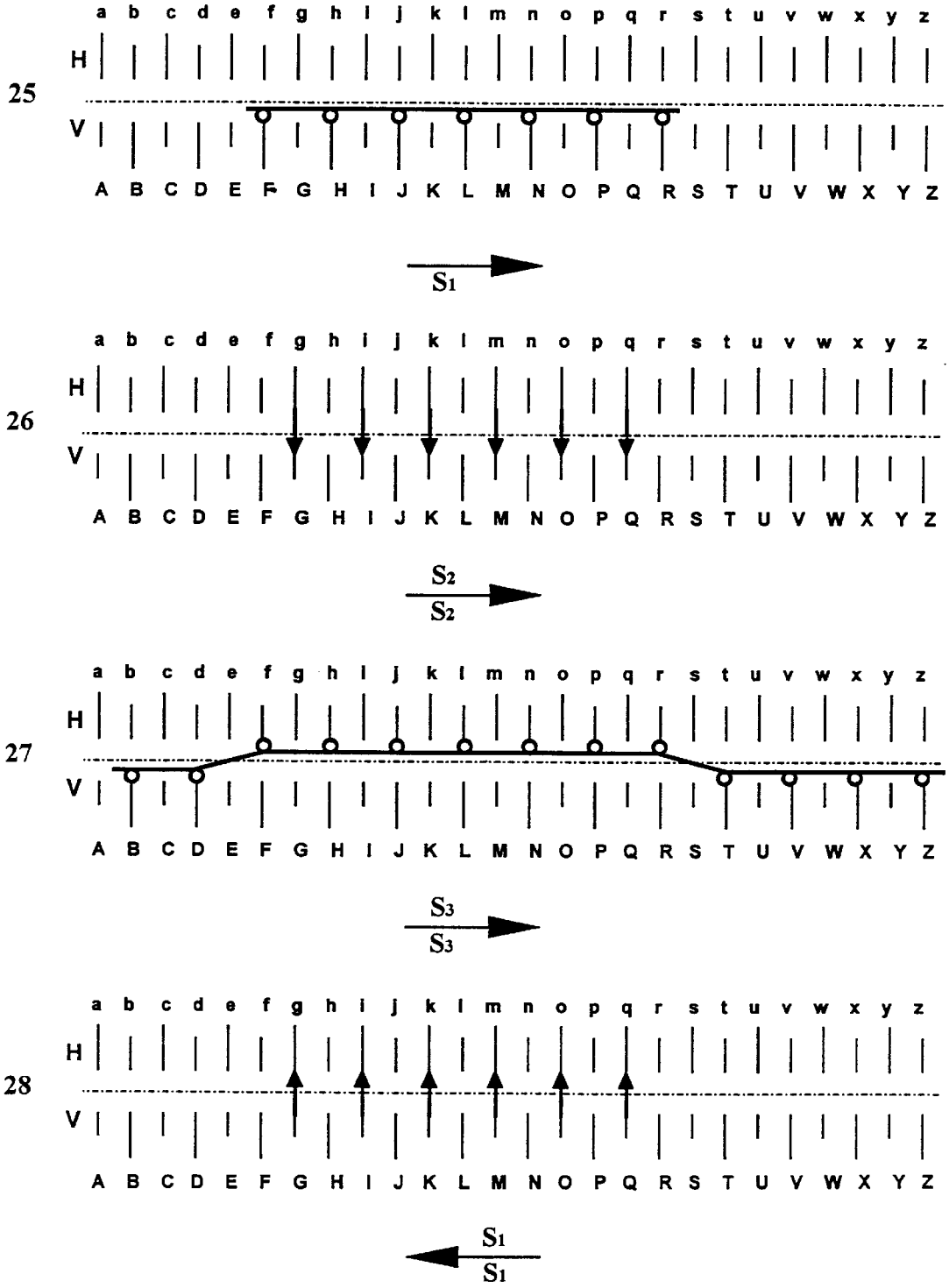
Fig. 2.7

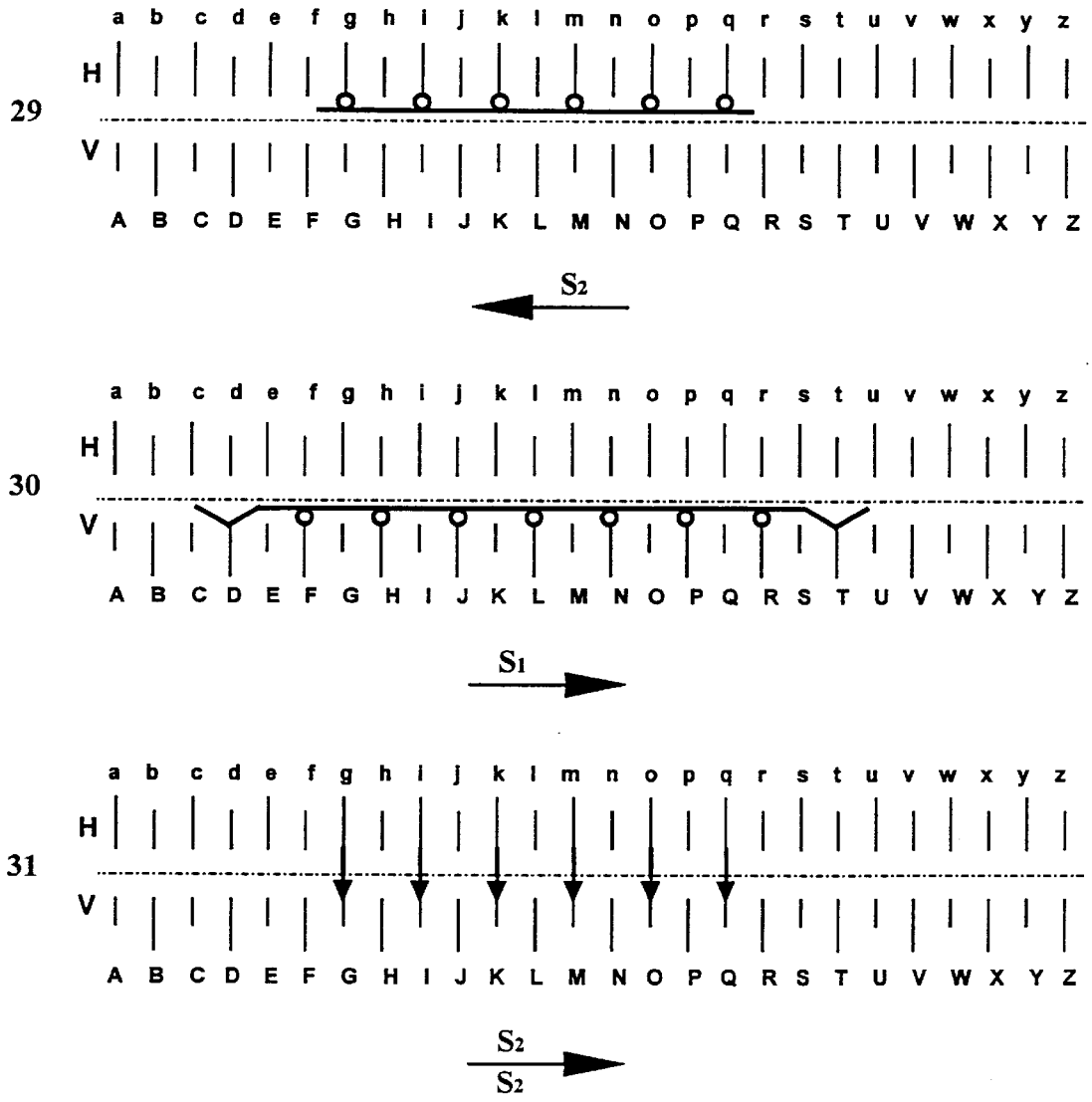
Fig. 2.8

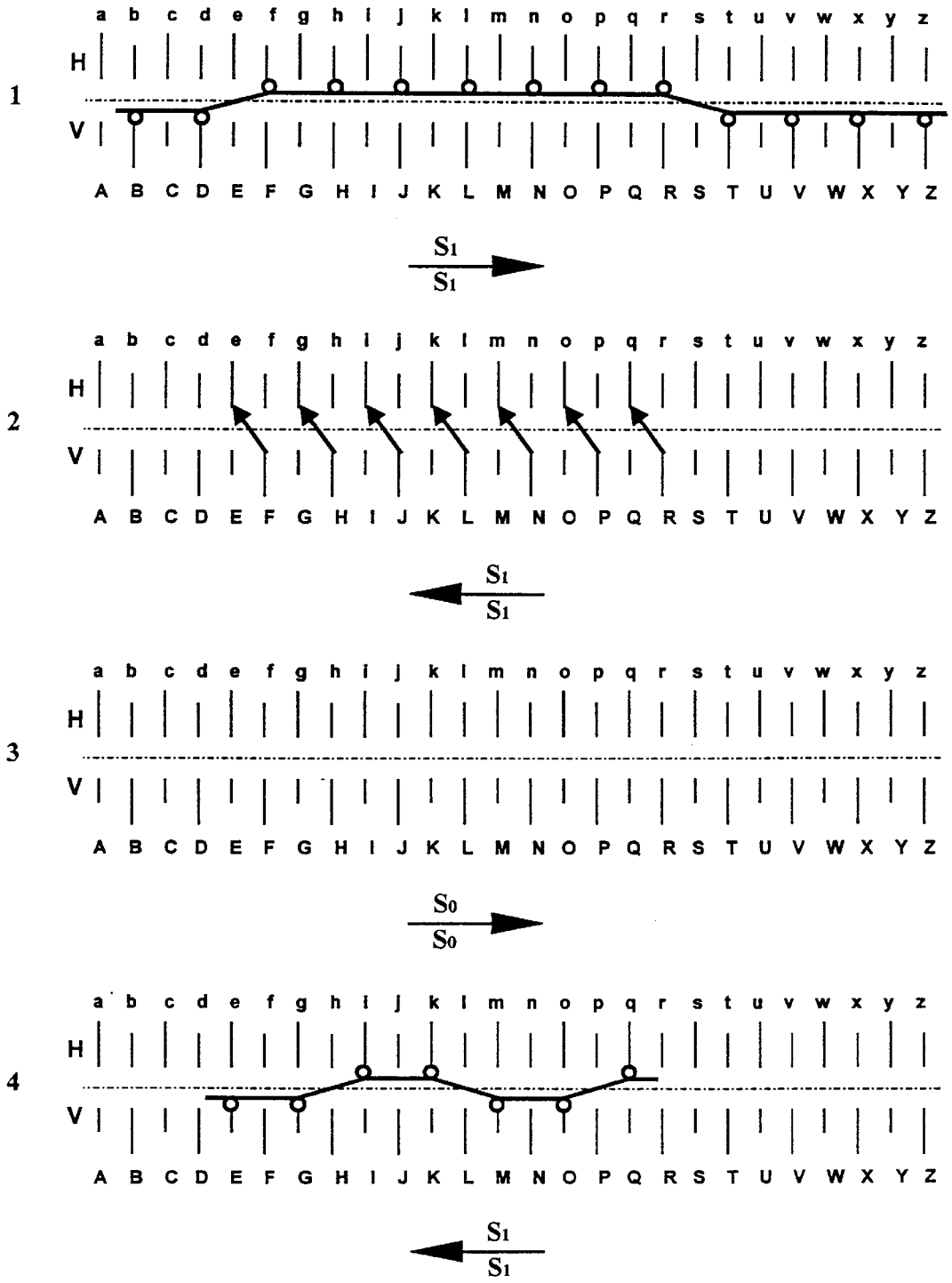
Fig. 4.1

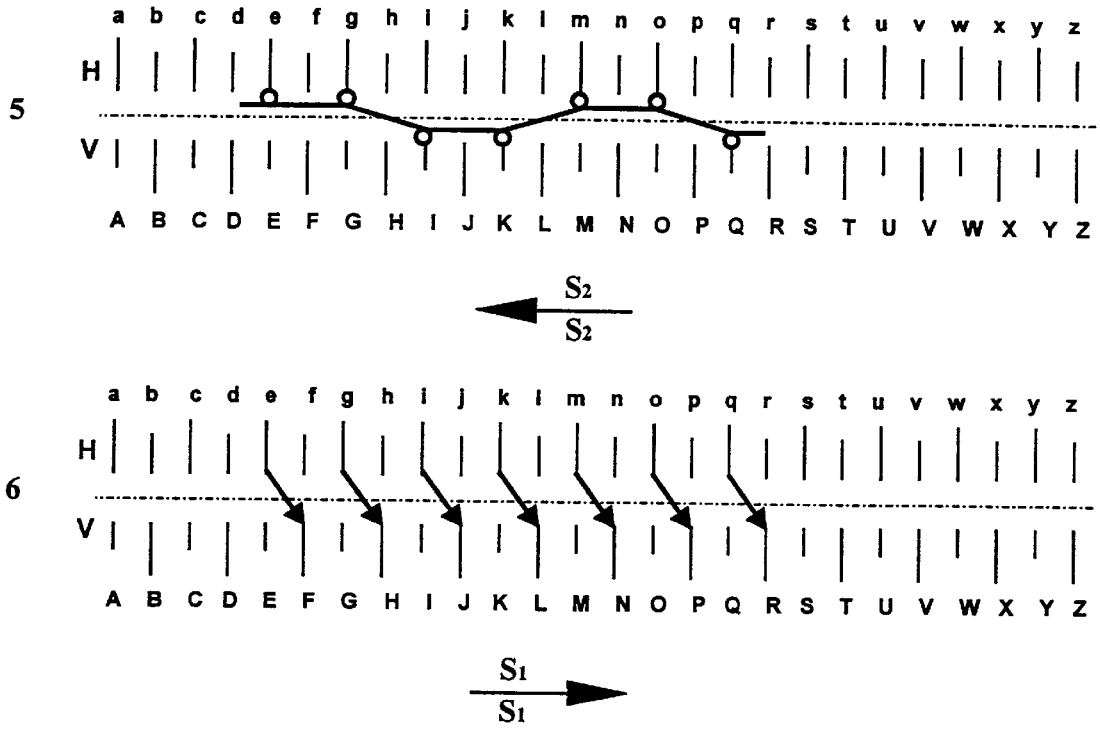
Fig. 4.2

METHOD OF PRODUCING A KNITTED ARTICLE ON A FLAT KNITTING MACHINE

BACKGROUND OF THE INVENTION

The present invention relates to a method of producing a knitted article on a flat knitting machine.

In articles of clothing as well as in technical knitted articles, it is desirable to produce flat knittings for different applications which at least locally are formed of three flat knittings arranged in parallel planes. One of the applications is for example the knitting-in of a pocket pouch in a jacket or the like. It is known to produce such a pocket pouch as a hose-shaped bulge of the base knitting, wherein the pouch has an open side edge which, after removal of the knitted piece from the machine, must be closed by hand. It is believed that this known method can be further improved.

SUMMARY OF THE INVENTION

Accordingly, it is an object of the present invention to provide an improved method of producing a knitting on a flat knitting machine, in particular a knitted article with the use of the above mentioned post-working step, on a flat knitting machine with two oppositely located needle beds and a loop transferring device, wherein a knitting has a base knitting and at least one parallel knitting which partially covers the base knitting and formed of at least two flat knittings arranged in parallel planes, and at least in the region of at least one of a parallel knitting at most each second needle of one needle bed is bound with a loop of the base knitting, and the needle of the other needle bed which is opposite of the one bound needle of the one needle bed is empty, and wherein one flat knitting of the parallel knitting is produced on the needle bed which is opposite to that for forming the base knitting, and the other flat knitting is produced on the base knitting in the empty needles of the corresponding needle bed.

Preferably, the parallel knitting can be connected at least in one point with the basic knitting. Also, the flat knittings of the parallel knitting can be connected with one another at least partially. The base knitting can be knitted in all known binding techniques which are produced with the above described needle separation. The binding techniques can alternate with one another.

The shape of the base knitting as well as the flat knitting of the parallel knitting has no limitations. Moreover, the parallel knitting can be arranged at any point of the basic knitting. The number of the flat knittings of the parallel knittings depends on the number of the empty needles between the needles bound with a loop on the both needle beds. For the majority of the applications, parallel knitting with two flat knittings can be sufficient.

In accordance with further features of the present invention, the parallel knitting alternates from the rear side of the base knitting and the front side. Also, a method for producing of a parallel knitting is provided, whose one flat structure has a jacquard pattern, wherein the floating threads of the jacquard pattern are secured by the second flat knitting. The both methods are described hereinbelow with reference to the drawings.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a view showing a loop course for producing a knitting of FIGS. 1*a*–1*d;*

FIG. 3*a* is a partial view of a knitting with a pocket having a jacquard pattern;

FIG. 3*b* is a view showing a section taken along the line B—B of the knitting of FIG. 3*a;* and FIG. 4 is a view showing a loop course for producing the knitting of FIGS. 3*a*–3*b.*

DESCRIPTION OF PREFERRED EMBODIMENTS

Figure 1:
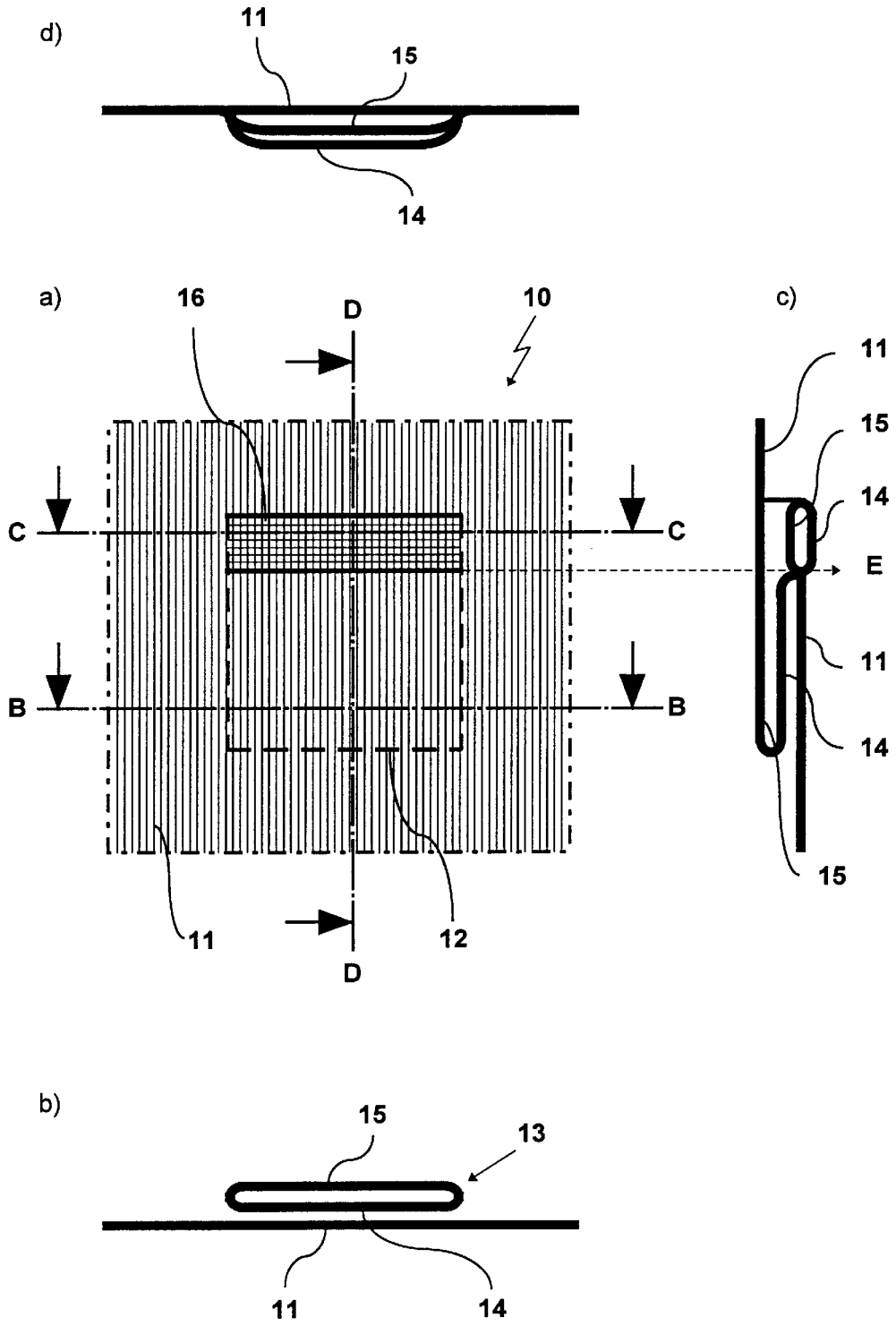
FIG. 1*a* is a partial view of a knitting with a pocket made in it.
FIG. 1*b* is a view showing a section taken along the line B—B through the knitting of FIG. 1*a;*
FIG. 1*c* is a view showing a section taken along the line D—D through the knitting of FIG. 1*a;*
FIG. 1*d* is a view showing a section taken along the line C—C through the knitting of FIG. 1*a;*

A knitting 10 shown in FIG. 1*a* is composed of a base knitting 11 in which a pocket 12 is made. As can be seen particularly from consideration of FIGS. 1*b* and 1*c,* the pocket 12 has a pocket pouch 13 which is closed at side edges and at the bottom. The pouch 13 is formed by two flat knittings 14 and 15 which are arranged in parallel planes and connected with one another at the edges and at the bottom. In the upper region, the pocket 12 is provided with a gripping strip 16 shown in FIG. 1*a.* The gripping strip is also formed by both flat knittings 14 and 15 as shown in FIGS. 1*c* and 1*d.* At the transition between the pocket pouch 13 and the gripping strip 16, the both flat knittings 14 and 15 which form the parallel knitting to the base knitting 11 alternate from the rear side of the base knitting 18 to its front side. In FIG. 1*c* this plane is identified with reference letter E.

FIG. 2 illustrates the loop course for producing the knitting 10 in accordance with FIG. 1. Right loops of the base knitting are formed with each second needle B, D, F, H, J, L, N, P, R, T, V, X, Z of the front needle bed V in a row 1 in a knitting direction from left to right with a first knitting system and a first thread guide. Subsequently, the initial rows of both flat knittings 14 and 15 are formed in a row 2 in a knitting direction from right to left with the first knitting system S1 and a second thread guide on the front and rear needle beds V and H. Then, the formation of a safety knitting row is performed with the first knitting system S1 and the second thread guide in a row 3 in a knitting direction from left to right.

In the same knitting direction, in row 4 the loops of the initial row of the front flat knitting 14 are suspended with a second knitting system S2 on empty needles e, g, i, k, m, o, q of the rear needle bed H, before the right loops of the base knitting 11 are formed on the front needle bed V in a knitting direction from right to left with the first knitting system S1 and the first thread guide. The loops of the front flat knitting 14 are again suspended back on the front needle bed V in a row 6 in a knitting direction from right to left with the second knitting system S2. Subsequently, a loop row for the front flat knitting 14 is formed in a row 7 in the same knitting direction with a third knitting system S3 and the second thread guide. The formation of a loop row for the rear flat knitting 15 is performed in a row 8 with the knitting system S1 and also with the second thread guide. The both flat knittings 14 and 15 are produced with the same threads, whereby their lateral connection is provided.

The loops of the front flat knitting 14 are transferred to the rear needle bed H in a row 9 with the second knitting system S2. Then, again a loop row for the base knitting 11 is formed in a row 10 on the front needle bed V, before the loops of the front flat knitting 14 are suspended back in the empty needles E, G, I, K, M, 0, Q of the front needle bed V in a row 11 with the knitting system S1 in a knitting direction from right to left. Then a new formation of a loop row for the front flat knitting 14 is performed in a row 12 with the second knitting system S2 and the second thread guide, before a loop row for the rear flat knitting 15 is produced on the rear needle bed H in a row 13 with the same thread guide in the opposite knitting direction with the knitting system S1. The loops of the front flat knitting 14 are transferred in the empty needles of the rear needle bed H in a row 14 with the second knitting system S2. Subsequently, the cycle of the rows 5–14 is repeated so many times until the pocket pouch 13 achieves its desired length.

In rows 15–21 the exchange of the both flat knittings 14 and 15 is performed from the rear side of the base knitting 11 to the front side of the base knitting 11. In a row 15, the loops of the front flat knitting 14 are suspended to the loops of the base knitting 11 in a knitting direction from right to left with a first knitting system S1. The row 16 serves for movement of the thread guide, before right loops of the base knitting 11 are produced in a row 17 with the knitting system S1 and the first thread guide on the front needle bed V and the left loops of the base knitting 11 are produced on the rear needle bed H in the region of the pocket 12. New starting rows for the flat knittings 14 and 15 are formed in a row 18 with a second knitting system S2 and the second thread guide on the front and rear needle bed V and H. A safety row for the front flat knitting 14 is formed in a row 19 with the knitting system S1 on the front needle bed, before the loops of the rear flat knitting 15 are transferred in a row 20 with the knitting system S2 in the empty needles of the front needle bed V. Then, a loop row for the base knitting 11 is formed in a row 21 with a third knitting system S3 on the front and rear needle beds V and H.

The rows 22–31 include the formation of the engaging strip 16 on the pocket 12 as shown in FIG. 1. A loop row for the base knitting 11 is formed on the front and rear needle beds with the first knitting system S1 and the first thread guide in a knitting direction from right to left. Subsequently, the loops of the rear flat knitting 15 are transferred in a row 23 with the knitting system S2 in the empty needles of the rear needle bed H. A loop row for the rear flat knitting 15 is formed in a row 24 with a third knitting system S3 and the second thread guide in a knitting direction from right to left. This loop row is connected by tuck hooks T and D with the base knitting 11 on the front needle bed V.

The formation of a loop row for the front flat knitting 14 is performed in a row 25 with the first knitting system S1 and the same thread guide as for the formation of the loop row for the rear flat knitting 15 in the row 24. Subsequently, the loops of the rear flat knitting 15 are transferred in a row 26 in the empty needles of the front needle bed V, before a loop row for the base knitting 11 is formed in a row 27. The back hanging of the loops of the rear flat knitting 15 are performed in a row 28 on the rear needle bed H. A loop row for the rear flat knitting 15 is performed in a row 29. The formation of a loop row for the front flat knitting 14 is performed in a row 30 in an opposite knitting direction, and this loop row is again connected by the tuck hooks D and T with the base knitting 11 on the front needle bed. Then, the loops of the rear flat knitting 15 are transferred in a row 31 in the empty needles of the front needle bed V, and the cycle of the rows 22–31 is repeated until the pocket engaging strip 16 reaches the desired height.

FIG. 3*a* shows a further knitting 20 with a pocket 22, wherein the pocket 22 has a two-color jacquard pattern 23. As can be seen from FIG. 3*b*, here the pocket 22 is formed not by a pocket pouch. It deals with a pocket which is placed on the base knitting 21. The pocket 22 is formed in the region of the jacquard pattern 23 by two flat knittings 24 and 25 which are arranged in parallel planes. The rear plane 25 serves for binding of the floating threads of the jacquard pattern 23 of the front flat knitting 24, so that during insertion of the hand into the pocket 22 no hanging on the floating threads occurs as in the case when the flat knitting 25 is not available.

Figure 3:
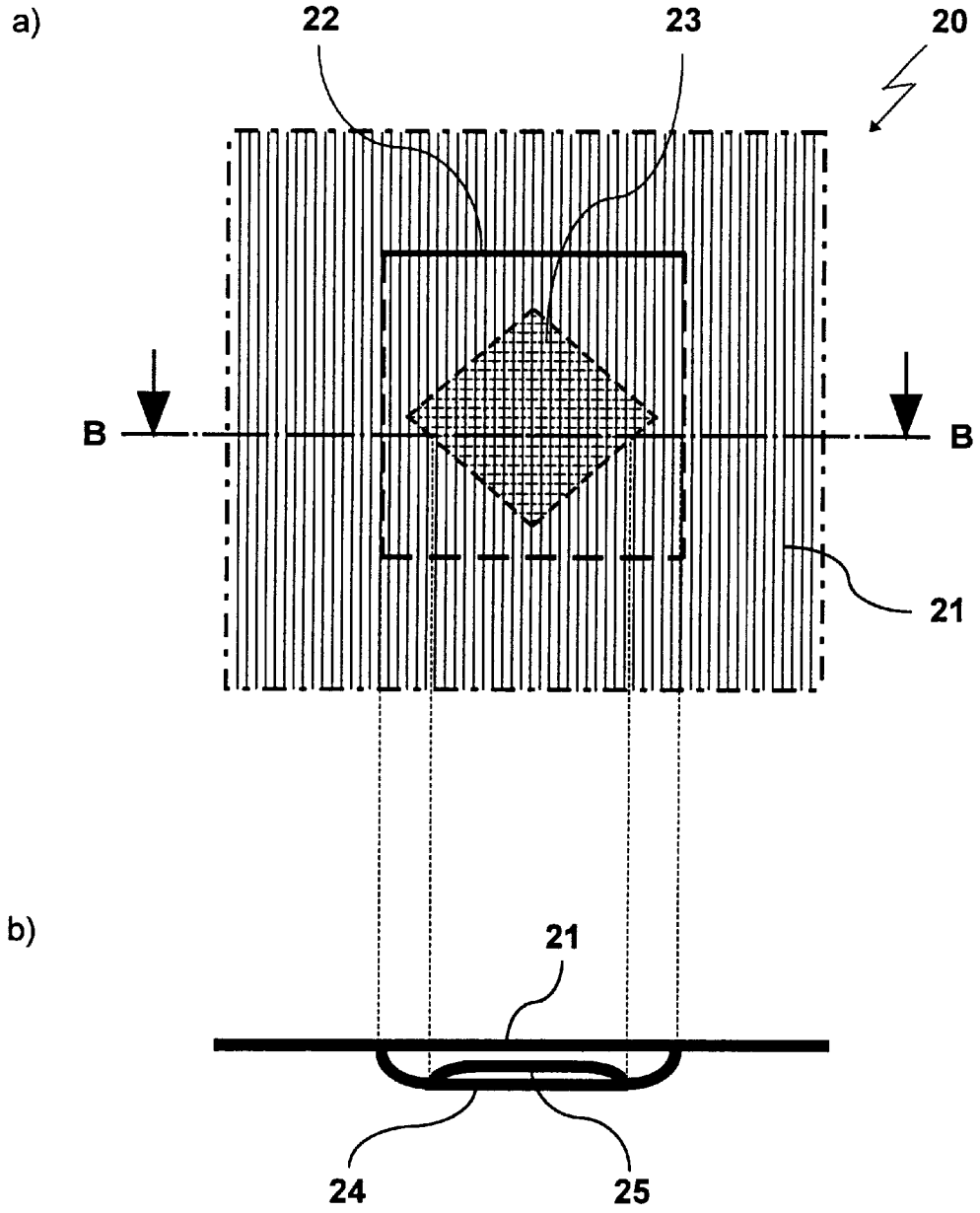

FIG. 4 shows the loop course for producing the knitting of FIG. 3. The method is not limited to the production of a color jacquard-patterned pocket. It can be used also at any other point of a hose round-finished knitting, on which a colored jacquard pattern must be placed. In FIG. 4 the illustration is limited to a loop course for color row of the height register of the color jacquard. This knitting cycle is repeated until the total color jacquard pattern region 23 is finished.

A loop row for the base knitting 21 is formed in a row 1 in a knitting direction from left to right on the front needle bed V and the rear needle bed H. The loops on the rear needle bed H form the pocket rear side. Subsequently, the loops of the rear flat knitting 25 are transferred in a row 2 in the empty needles of the rear needle bed H. The needle beds are again offset relative to one another in a row 3 so that they reach the outlet position. In a row 4 a knitting is performed with a first knitting system S1 and the base color of the color jacquard pattern region 23 in the region of the front flat knitting 24, and binding is performed in the region of the rear flat knitting 25. In a row 5 the formation of the loops is performed on the front needle bed in the region of the front flat knitting 24 with a second knitting system S2 and the second color of the jacquard pattern, and the threads are bound again in the region of the rear flat knitting 24 on the rear needle bed H. Subsequently, the loops of the rear flat knitting 25 are suspended in the empty needles of the front needle bed V in a row 6, before a new cycle of the rows 1–6 is performed.

It is to be understood that the method can be also used on color jacquard patterns with more than two colors.

It will be understood that each of the elements described above, or two or more together, may also find a useful application in other types of methods differing from the types described above.

While the invention has been illustrated and described as embodied in method of producing a knitted article on a flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing a knitting on a flat knitting machine with two opposite needle beds and a loop transferring device, comprising the steps of forming a knitting which has a base knitting and at least one parallel knitting which partially overlaps the base knitting and is formed of at least two flat knittings arranged in parallel planes; binding in a region of the at least one parallel knitting each other needle of one needle bed with a loop of the base knitting; keeping empty a needle of the other needle bed which is opposite to the bound needle of the one needle bed; producing one of the flat knittings of the parallel knittings on a needle bed which is opposite to the needle bed for forming the base knitting; and producing the other flat knitting in the empty needles of the needle bed on which the base knitting is produced.

2. A method as defined in claim 1; and further comprising the step of connecting the parallel knitting at least at one point with the base knitting.

3. A method as defined in claim 1; and further comprising the step of connecting the flat knittings of the parallel knitting at least partially with one another.

4. A method as defined in claim 1; and further comprising the step of forming the parallel knitting from two flat knittings which are arranged locally behind the base knitting and locally in front of the base knitting; and for producing the flat knitting behind the base knitting performing the following steps:

a. forming a loop row for the base knitting on a front needle bed;

b. transferring all loops of a first flat knitting from a rear needle bed to empty needles of the front needle bed;

c. forming a loop row for the first flat knitting on the front needle bed;

d. forming a loop row for a second flat knitting on the rear needle bed;

e. transferring the loops of the first flat knitting from the front needle bed to the rear needle bed;

f. repeating the steps a–e until the flat knittings reach a desired length; and

For exchanging the flat knittings from a rear side to a front side of the base knitting performing the following steps:

g. transferring the loops of the first flat knitting on the front needle beds to the loops of the previous base knitting;

h. forming a loop row for the base knitting on the front needle bed and in a region of the parallel knitting on the rear needle bed;

i. forming of initial loop rows for a new first and second flat knitting on the front needle bed or in empty needles of the rear needle bed;

j. forming a loop row for the first flat knitting on the front needle bed;

k. transferring the loops of the second flat knitting in the empty needles of the front needle bed;

l. forming a loop row for the base knitting;

and in a further course performing the following steps:

m. forming a loop row for the base knitting;

n. forming a loop row for the second flat knitting (15) on the rear needle bed H;

o. forming a loop row for the first flat knitting on the front needle bed;

p. transferring the loops of the second flat knitting in the empty needles of the front needle bed;

q. forming a loop row for the base knitting on the rear needle bed;

r. repeating the steps n–q until the parallel knitting reaches a desired length.

5. A method as defined in claim 1; and further comprising the step of providing the parallel knitting of a flat knitting with a jacquard pattern covered by a second flat knitting on a rear side, with the use of the following steps:

a. forming a loop row for the base knitting on a rear needle bed;

b. transferring the loops of the second flat knitting on empty needles of a rear needle bed;

c. knitting of loops of the first flat knitting in a base color of the jacquard pattern on the front needle bed and binding this thread on needles of the second flat knitting on the rear needle bed;

d. knitting of loops of the first flat knitting in a second color of the jacquard pattern on the front needle bed and binding this thread on needles of the second flat knitting on the rear needle bed;

e. transferring the loops of the second flat knitting to the front needle bed;

f. repeating the steps a–e until a jacquard-pattern region reaches a desired length.

* * * * *